United States Patent [19]

Engle

[11] 3,964,211

[45] June 22, 1976

[54] STONE WEAR INDICATION ON A HONING MACHINE

[75] Inventor: Robert C. Engle, Holland, Mich.

[73] Assignee: Ex-Cell-O Corporation, Troy, Mich.

[22] Filed: July 31, 1975

[21] Appl. No.: 600,697

[52] U.S. Cl. ..... 51/165.87; 51/263

[51] Int. Cl.[2] ..... B24B 49/00

[58] Field of Search ..... 51/2 C, 67, 165.87, 51/165.88, 165 R, 263

[56] References Cited

UNITED STATES PATENTS

| | | | |
|---|---|---|---|
| 2,244,806 | 6/1941 | Schmidt | 51/67 |
| 3,097,455 | 7/1963 | Flohr | 51/165 R |
| 3,490,179 | 1/1970 | Militzer et al. | 51/67 |
| 3,561,164 | 2/1971 | Dunn | 51/165.87 |
| 3,760,539 | 9/1973 | Robillard et al. | 51/165.88 |
| 3,772,829 | 11/1973 | Asano et al. | 51/165.87 |
| 3,791,084 | 2/1974 | Kakumu et al. | 51/165.87 |

*Primary Examiner*—Al Lawrence Smith
*Assistant Examiner*—Robert C. Watson
*Attorney, Agent, or Firm*—James H. Bower; Frank D. Risko

[57] ABSTRACT

An apparatus for indicating replacement of an abrasive stick or stone in a honing machine by utilizing an air pressure sensor in conjunction with the feed cylinder for the abrasive stick.

10 Claims, 6 Drawing Figures

STONE WEAR INDICATION ON A HONING MACHINE

BACKGROUND OF THE INVENTION

1. Field of the Invention

This invention relates to a fluid, flow-responsive type switch mechanism for deactivating an electrical circuit.

2. Description of the Prior Art

The use of mechanical limit switches to indciate a specific position or the wear point of a given tool is well known in the abrading field. This wear signal has been accomplished in the art by interconnecting a lever or plunger type device and a limit switch to either indicate to the machine operator that a tool has worn and should be replaced or can be connected directly to a circuit contol contactor and shut the given machine down completely. A limit switch operated by a plunger mechanism of the type described is shown for detecting the stone wear of an abrading tool in U.S. Pat. No. 3,490,179 (FIG. 13). This limit switch operates at very low voltages and must be of the enclosed type because of the environment in which it is used. The coolant and abrasive particals cause the switch mechanism to foul and short out which can give an incorrect reading that the abrasive is worn out. Also the enclosed type limit switches are more costly.

SUMMARY

This invention provides an inexpensive apparatus for signalling the stone wear of an abrading tool as used in a honing machine. It is operated from the same original fluid source which is used to feed the stone during a honing operation of the part but does have a separate pressure regulator for its operation. This reduces the need for electrical contacts or an electrical switch in the proximity of the honing tool itself. This invention is self-cleaning and non-clogging which aids in the efficiency of operation of the honing operation. It further eliminates the need for an enclosed type switch which is expensive or an unenclosed limit switch which can be subjected to the adverse environment of abrading dust and coolant. Further, electrical wires connected to a switch of the type used in a honing machine are required to flex during its use. After a period of time they can become cold worked, will brake thus causing machine downtime due to the malfunction and the costly repair of the wiring harness. This invention eliminates this type failure.

Other features and advantages of this invention will become apparent from the description, claims and drawing.

DESCRIPTION

Figure 1:
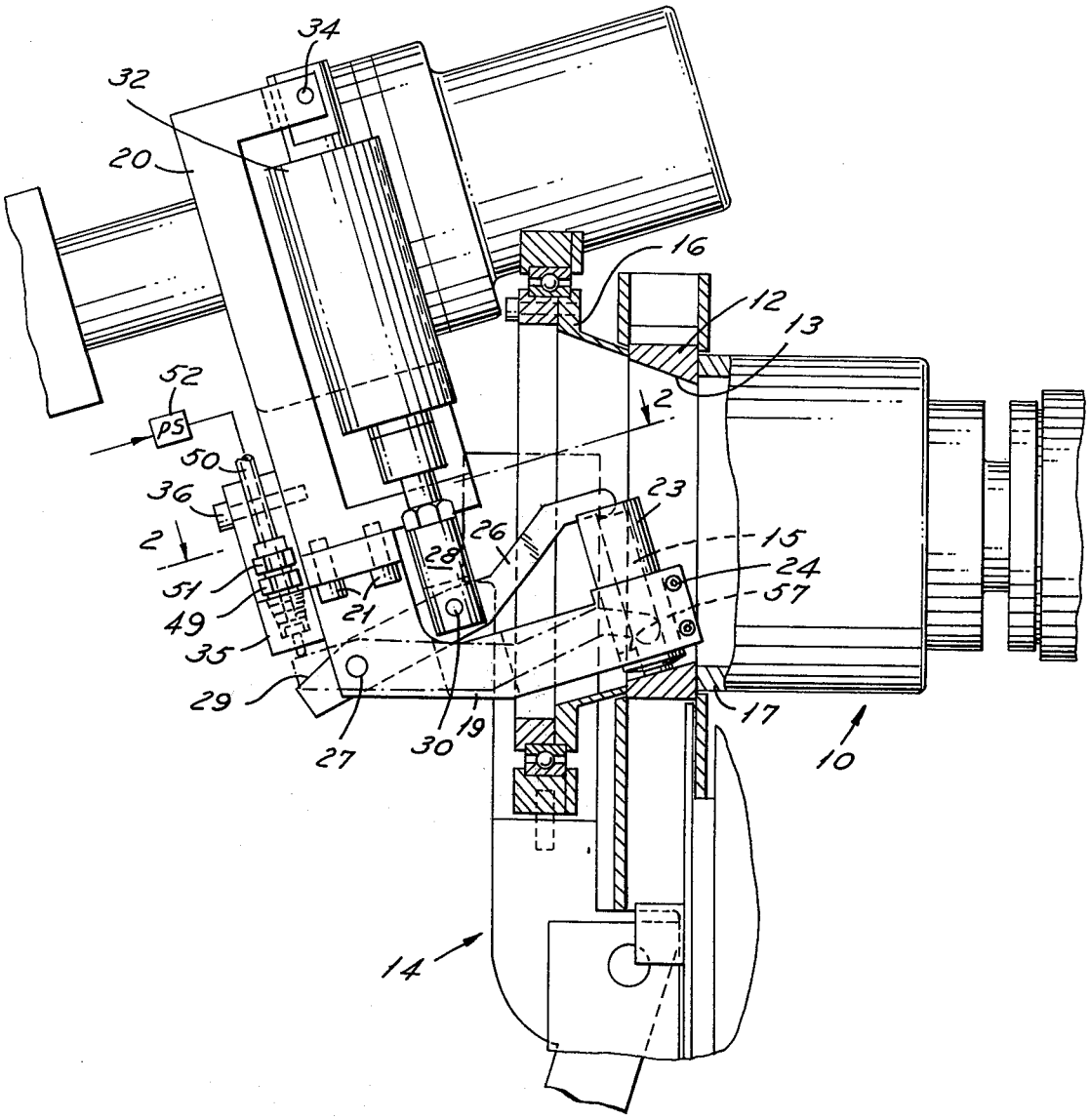
FIG. 1 is a side elevation of the lever operated stone wear switch mechanism.

In FIG. 1 the bearing race 12 to be honed is held against spindle 10 by yoke assembly 14. Here the pressure ring 16 affixedly held to yoke assembly 14 holds the race 12 against the spindle driver 17. The honing stone feed mechanism consists of a bracket 19 held to actuator holder 20 by screws 21. Stone guide 23 is affixed to bracket 19 by screw 24 best shown in FIG. 2. Lever 26 is pivoted by pin 27 affixed in bracket 19 and also connected to clevis 28 by clevis pin 30. The clevis is affixedly held to the actuator feed cylinder 32 by a retaining means with the cylinder 32 affixed by pin 34 to actuator holder 20. Pin 34 is fitted so that cylinder 32 can pivot freely.

Figure 2:
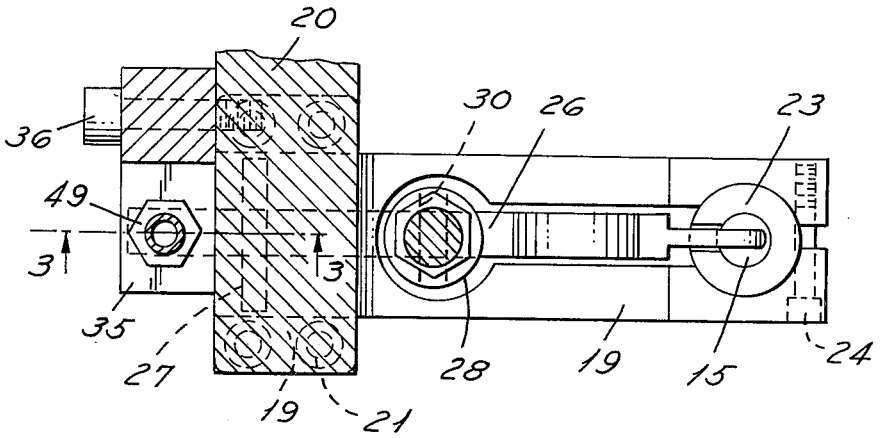
FIG. 2 is a plan sectional view taken along line 2—2 in FIG. 1 thereof.
Figure 3:
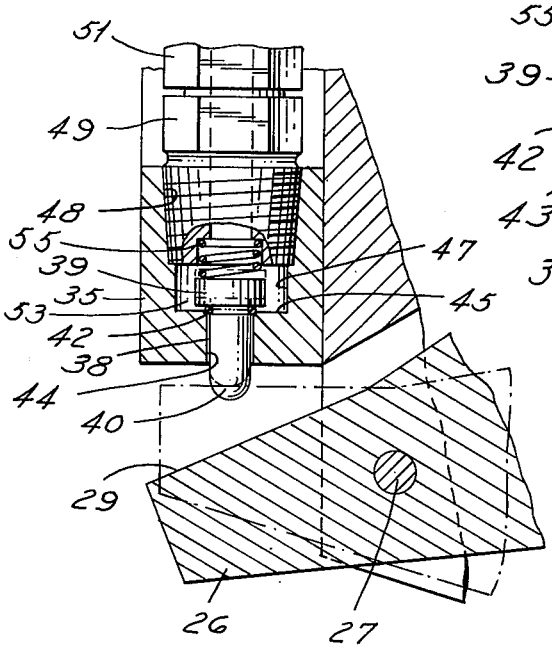
FIG. 3 is a sectional view of the switch mechanism taken along line 3—3 in FIG. 2 thereof.
Figure 4:
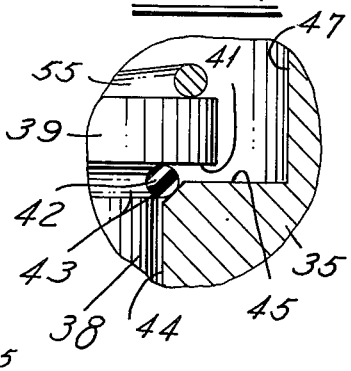
FIG. 4 is a fragmentary section taken in FIG. 3 to show plunger and O-ring details.

Valve body 35 is affixed to holder 20 by screw 36 shown in FIG. 2. In FIG. 3 housed inside the valve body 35 is a plunger consisting of head end 39 and rod end 40. The rod end has a spherical radius shown but could easily be some other convenient shape. Surface 45 is finished so the shoulder surface 41 can form a metal to metal seal with surface 45. In the preferred embodiment an O-ring 42 is fitted around the rod end 40 and recessed into the undercut 43. Hole 44 in valve body 35 is slightly larger than rod end diameter 38 so that it is loosely held and fluid can pass easily. When plunger is in place the O-ring 42 will form a seal against surface 45. Diameter 47 is the convenient tap drill size for the thread 48 which mates with hose fitting 49. Conduit 50 is a flexible hose which is coupled to fitting 49 to valve body 35 by connector 51 and to air pressure switch 52 which can be remotely located. This switch is a three pole switch with the contacts connected in the circuit so they are normally open. When pressure is increased to the switch, the contacts will transfer to a normally closed position and stay there as long as pressure is maintained. Chamber 53 is formed by surface 45, diameter 47 and the thread end of fitting 49.

Figure 5:
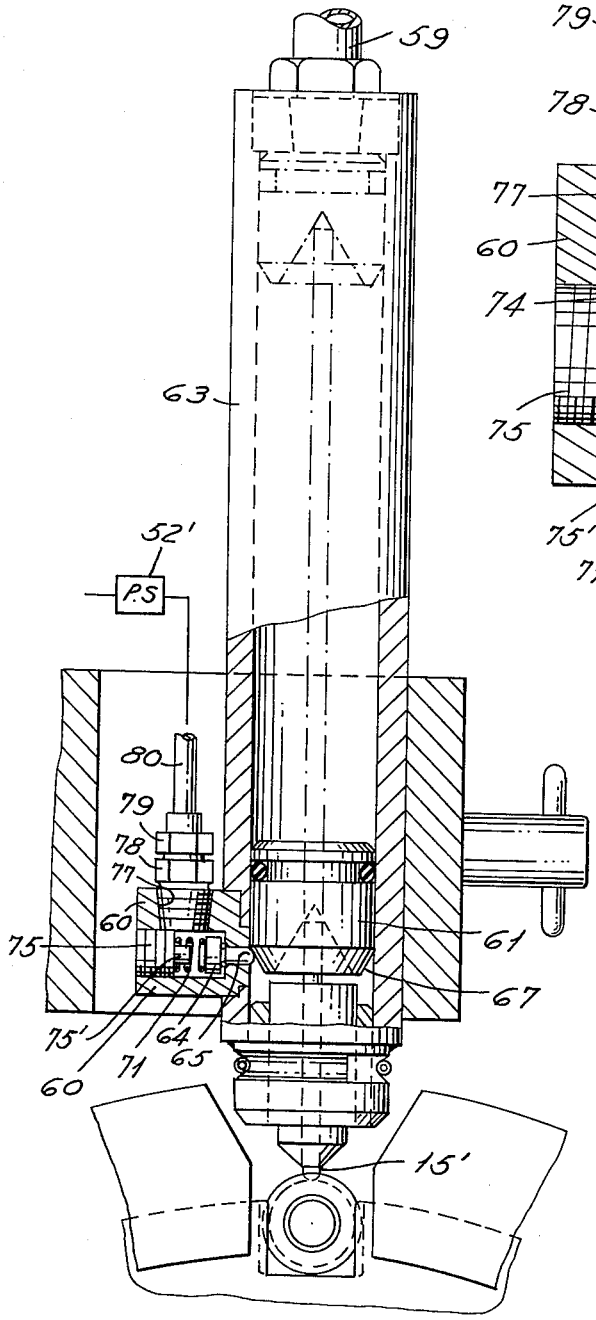
FIG. 5 is a section view of the side elevation of a piston operated stone wear switch mechanism.

FIG. 5 shows another embodiment wherein the stone wear switch is operated by a piston member 61 having a conic surface 67.

Here the valve body 60 is affixed to an abrasive feed cylinder 63 by a retaining means. Housed inside valve body 60 is a plunger consisting of head end 64 and rod end 65. The rod end has a spherical radius shown but could easily be some other convenient shape. Surface 66 is finished so the shoulder surface 68 can form a metal to metal seal with surface 45. In the preferred embodiment an O-ring 69 is fitted around the rod end 65 of the plunger and recessed into the undercut 70. Hole 72 in valve body 60 is slightly larger than rod end diameter 73 so that it is loosely held and fluid can pass easily. When plunger is in place the O-ring 69 will form a seal against surface 66. Diameter 76 is the convenient tap drill size for the threads for plug 75. Valve body 60 is tapped with thread 77 which mates with hose fitting 78 to valve body 60 by connector 79 and to a pressure switch 52' which can be remotely located and will operate in the same manner as the aforementioned pressure switch 52. Chamber 74 is formed by surface 66, diameter 76 and plug 75. Compression spring 71 is disposed between plug and head 64 of plunger and is piloted on diameter 75'.

OPERATION

Bearing race 12 is loaded into honing machine and locked against spindle driver 17 by yoke assembly 14 having pressure ring 16 contact and press bearing 12 against spindle 10 and it is brought up to proper speed. The actuator holder 20 is moved into position and the fluid operated feed cylinder 32 is then actuated which causes lever 26 to pivot about pin 27 and extend abrasive 15 to contact bearing surface 13. At this same time fluid pressure is expended into pressure switch 52 and down conduit 50 into chamber 53. Here the pressure will cause plunger 38 to seat the o-ring 42 tightly against surface 45 causing no flow of fluid through the system and keeping pressure high on switch 52. The honing operation is the lateral movement of the abrasive 15 across surface 13. As honing takes place the abrasive 15 is fed down through stone guide 23 by operation of cylinder 32 against clevis 28 and clevis pin 30 pushing the lever 26 against one end of abrasive 15. As wear takes place, surface 29 of lever 26 will move upward toward plunger 38. As surface 29 contacts plunger 38 and lifts it and the o-ring 42 off the seat 45, the pressure which had been previously built up in chamber 53 will now be released. This action will cause the pressure switch 52 which had been closed to now move to its normally open position. The switch can be connected in the electrical circuitry of the honing machine so it can automatically shut the machine down after it has completed that particular honing cycle or it can be connected to a relay or other circuit element and cause a light to flash, a buzzer to sound or other such alarm to indicate that stone wear had occurred to the point where this stone should now be replaced.

The preferred fluid embodiment would be to use a factory air system wherein the air is prefiltered to remove moisture and other contaminents. This embodiment further will be self-cleaning since air flow past the sealing surface will dispell any dirt particles if they should accumulate in the area of the switch. It further removes any electrical contacts in the proximity of the honing tool and its coolants and allows the pressure switch used to trigger the alarm to be remotely located if necessary or at least located in an enclosure protected from the environment with the other controls. Shop air for operating such a device is normally readily available in most machine shops or specifically in honing operations. A spring 55 having a light load may be added to the device as shown in FIG. 3 to aid in maintaining original sealing of chamber 53 and will also allow the invention to operate in any position. That is, it may also be operated in any physical position without loss of efficiency or principal.

Further a stop is built into the system in the stone guide 23 by slot surface 57 which will prevent the lever 26 from feeding beyond that point by contact with it so that the end of lever 26 urging stone 15 will not contact bearing surface 13 causing damage to it and scrapage of the part.

Figure 6:
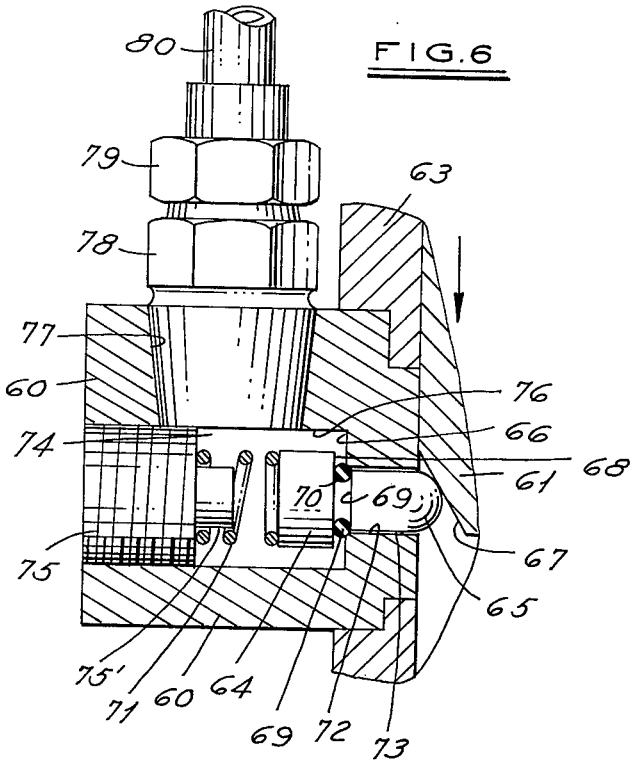
FIG. 6 is an expanded scale section of FIG. 5 to show plunger and seal details.

In another embodiment, as shown in FIGS. 5 and 6 an abrasive stick 15' is fed by piston 61 activated by factory air feeding through conduit 59. As stone wear takes place conic surface 67 on piston 61 will unseat the O-ring 69 from surface 66 by pushing against the rod end 65 held in place by spring 71. Pressure in chamber 74 will be vented through hole 72 and cause pressure switch 52' to be moved to its other position similar to the operation of pressure switch 52 previously discussed. Again by my invention through the operation of the valve fluid such a factory air will keep the mechanism self-cleaning allowing remote location of the pressure switch 52' to a less caustic environment.

Modifications may be made to the device shown by persons skilled in the art and all such modifications being considered are within the spirit and scope of the invention except as limited by the appended claims.

I hereby claim:

1. In a honing machine having an abrasive mounted to automatically feed by action of a lever in conjunction with a feed cylinder and a fluid operated stone wear indicator switching apparatus comprising:

a. a lever pivotally mounted to contact said abrasive in said feed cylinder and a plunger;
b. said plunger disposed in a valve body with rod end of said plunger extending therefrom;
c. said plunger making a seal against said valve body; and
d. communication conduit between said valve body and pressure switch communication thereto a fluid pressure supply.

2. The apparatus of claim 1 wherein said fluid supply is factory air.

3. The apparatus of claim 1 wherein a spring is disposed in said valve body between plunger and connector.

4. The apparatus of claim 1 wherein an o-ring seal is disposed between said plunger and said valve body.

5. The apparatus of claim 3 wherein an o-ring seal is disposed between said plunger and said valve body.

6. In a honing machine having an abrasive mounted to automatically feed by action of a piston in conjunction with a feed cylinder and a fluid operated stone wear indicator switching apparatus comprising:

a. said piston moveably disposed in said cylinder;
b. a plunger disposed in a valve body with rod end of plunger extending therefrom;
c. said plunger making a seal against said valve body;
d. said piston contacting said rod end of said plunger; and
e. communicating conduit between said valve body and pressure switch communicating thereto a fluid pressure supply.

7. The apparatus of claim 6 wherein said fluid supply is factory air.

8. The apparatus of claim 6 wherein a spring is disposed in said valve body between plunger and connector.

9. The apparatus of claim 6 wherein an o-ring seal is disposed between said plunger and said valve body.

10. The apparatus of claim 8 wherein an o-ring seal is disposed between said plunger and said valve body.

* * * * *